United States Patent [19]

Wormser et al.

[11] Patent Number: 4,540,095

[45] Date of Patent: Sep. 10, 1985

[54] COUNTERWEIGHTED AERIAL TRAILER

[75] Inventors: Robert S. Wormser; Bruce C. Barton, both of Ocala, Fla.

[73] Assignee: Federal Motors, Inc., Ocala, Fla.

[21] Appl. No.: 582,820

[22] Filed: Feb. 23, 1984

[51] Int. Cl.[3] ..... B66C 23/72

[52] U.S. Cl. ..... 212/187; 212/195

[58] Field of Search ..... 212/187, 195, 255, 262, 212/265; 280/800

[56] References Cited

U.S. PATENT DOCUMENTS

| | | | |
|---|---|---|---|
| 2,571,908 | 10/1951 | Lyman | 280/800 |
| 2,925,149 | 2/1960 | Hughson | 212/195 |
| 2,985,317 | 5/1961 | Bannister | 212/195 |
| 3,029,088 | 4/1962 | Loef | 212/195 |
| 4,310,098 | 1/1982 | Dirksen | 212/195 |

*Primary Examiner*—Trygve M. Blix
*Assistant Examiner*—Stephen P. Avila
*Attorney, Agent, or Firm*—Beaman & Beaman

[57] ABSTRACT

A trailer for supporting aerial apparatus having a box-like frame defining a receptacle for receiving counterweight material such as cement or steel shot. Reinforcing partitions within the frame define a torque box highly resistant to frame twisting.

6 Claims, 3 Drawing Figures

COUNTERWEIGHTED AERIAL TRAILER

BACKGROUND OF THE INVENTION

Vehicle supported aerial equipment, for instance, fire trucks upon which extendable ladders are mounted, require a stable platform to adequately support the apparatus when fully extended. With fire-fighting vehicles of this type it is known to incorporate a torque box into the vehicle frame which is separate from the frame and highly resistant to twisting and deformation. The aerial apparatus is mounted upon the torque box which in turn is supported by the conventional flexible vehicle frame, and outriggers in the form of hydraulically operated ground-engaging jacks are mounted upon the torque box for engaging the ground and provide a stable platform. The use of a separate torque box and vehicle frame substantially increases the cost of manufacture of this type of vehicle.

It is an object of the invention to provide a vehicle frame, particularly a trailer frame, wherein the frame itself is in the form of a torque box highly resistant to twisting, and the frame defines a receptacle for receiving a counterweight material.

A further object of the invention is to provide a vehicle frame suitable for supporting aerial apparatus wherein the frame itself comprises a torque box for supporting the aerial apparatus, hydraulic outrigger ground-engaging supports being formed on the frame, and the frame construction being such as to define a receptacle for receiving a counterweight material.

In the practice of the invention the elongated trailer frame has a generally boxlike transverse cross section. The lateral sides of the frame are formed by channel beams whereby the base of the beams forms the frame sides, and the beam legs are disposed above and below the base, and extend toward the other channel beam.

A bottom plate bridges the lower legs of the channel beams lateral sides, and is welded thereto, and throughout much of the length of the frame the bottom plate is of a width greater than the distance separating the channel beams to add extra weight to the frame. An upper plate bridges the channel beam upper legs and is welded thereto to complete the box section of the frame.

Preferably, the bottom and upper plates are of heavy plate material in order to add to the weight of the frame, and rigidity to resist twisting is provided by the use of a plurality of plate-like K-braces located within the frame extending between the channel beam bases and welded thereto. Preferably, the vertical dimension of the bracing plates is substantially equal to the vertical dimension of the frame, and the lower edge of the bracing plates is welded to the bottom plate.

The receptacle defined by the lateral channel beams and the bottom plate is filled with a counterweight material, such as cement or steel shot, and this material substantially contributes to the weight of the frame to counteract the weight of the extended aerial apparatus. By the use of such low cost counterweight material the weight of the vehicle can be substantially increased at little cost.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
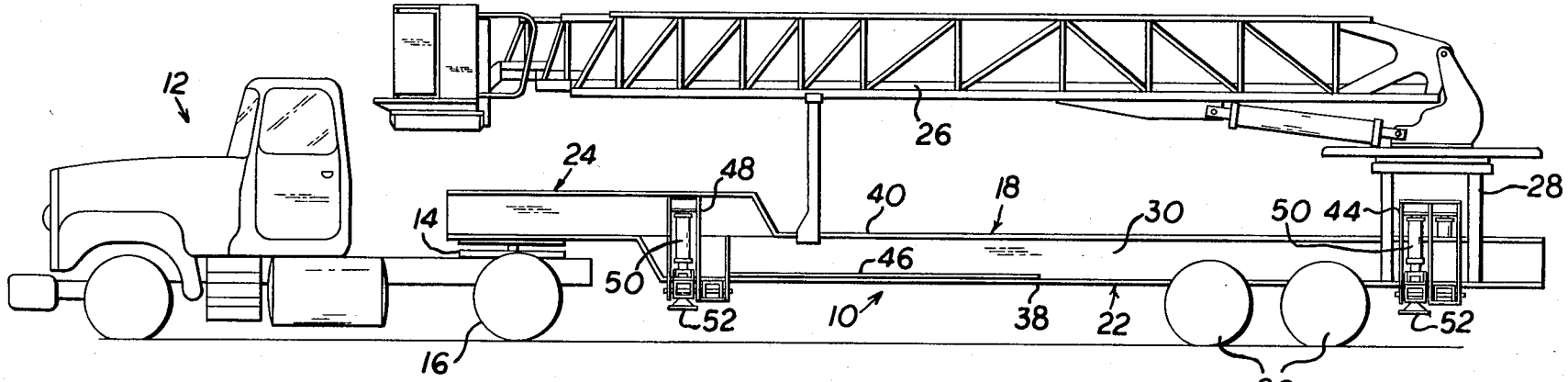
FIG. 1 is an elevational view of counterweighted aerial apparatus in accord with the invention.

With reference to FIG. 1, a fire fighting vehicle is illustrated of the semi-trailer type wherein the trailer is represented at 10, as pulled by a tractor 12. The trailer is attached to the tractor by the conventional fifth wheel 14 mounted over the tractor drive wheels 16.

The trailer 10 includes an elongated frame 18 supported on a pair of axles and wheels 20 and having a lower portion 22, and an upper portion 24. Aerial apparatus in the form of a conventional extendable ladder 26 is mounted upon a frame mounted elevated platform 28 extending above the frame. In the illustrated embodiment the platform 28 is located at the rear of the frame, but it is also possible to mount the platform at the frame front end upon upper portion 24 above the drive wheel 16.

Figure 3:
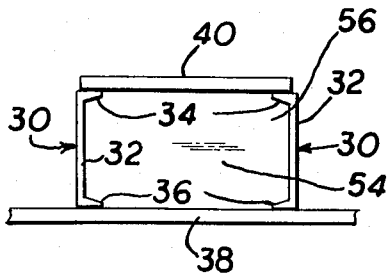
FIG. 3 is an elevational end view of the frame as taken from the right of FIG. 2, the top plate being illustrated.

The primary portion of the frame, the lower portion 22, and the upper portion 24, is formed of a boxlike configuration, and the lateral sides of the frame are defined by spaced parallel channel beams 30, FIG. 3. The channel beams 30 each include a base 32 having upper and lower legs 34 and 36, respectively, extending from the base in a common direction, and toward the other lateral channel beam.

A bottom plate 38 bridges the lower legs 36, FIG. 3, and is welded thereto. In a similar manner the upper plate 40 bridges the upper legs 34 and is welded to the upper legs during final assembly. Thus, the frame comprises a box configuration having a high inherent rigidity. The upper portion 22 is constructed in a similar manner.

In order to increase the weight of the frame 18, the bottom plate 38 and upper plate 40 are of heavy gauge material, such as $1\frac{1}{2}''$ steel plate, and where permitted by the trailer wheels 22, the bottom plate is of a wider dimension than the spacing between the lateral channel beams 30 to add further weight to the vehicle.

Figure 2:
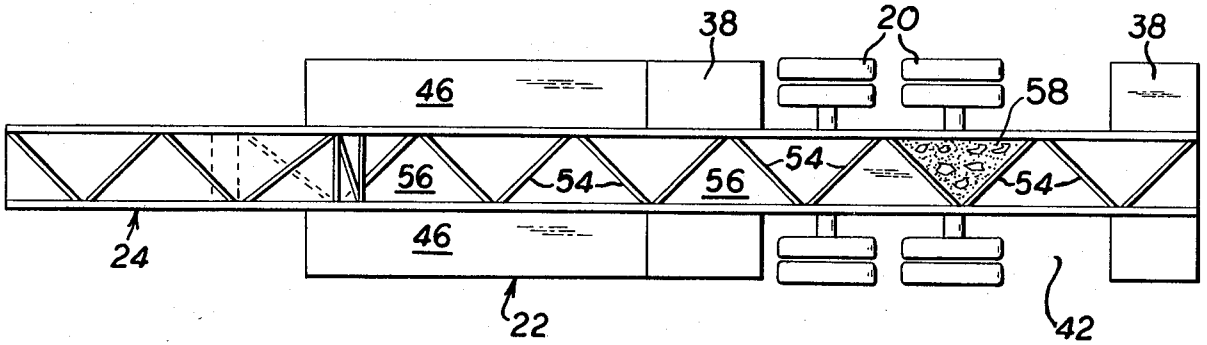
FIG. 2 is a top plan view of the trailer frame, per se, utilizing the invention, the top plate being removed for purpose of illustration.

With reference to FIG. 2 it will be noted that the bottom plate 38 is cut out at 42 to provide clearance for the wheels 20 and the rear outboard jacks 44. The cutout plate portions 46 are superimposed and attached upon a portion of the bottom plate 38 in front of the wheels 20, FIGS. 1 and 2, adding further weight to the vehicle.

The rear outboard jacks 44 and front jacks 48 are mounted upon the frame and include the usual hydraulic cylinders 50 and ground-engaging pads 52 for supporting the weight of the frame when the aerial apparatus is extended.

To increase the resistance of the frame to twisting, a plurality of K-bracing plates 54 are mounted within the frame 18. The K-bracing plates 54, FIG. 2, are fixed at their ends by welding to the channel bases 32, and, preferably, are of a vertical dimension equal to the vertical dimension of the frame whereby the lower edges of the plates are welded to the bottom plate 38.

To further increase the counterweight effect of the frame, the interior of the frame defines a receptacle 56 as formed by the lateral beams 30 and the bottom plate 38 and this receptacle is filled, intermediate the K-bracing plates 54, with a counterweight material 58, FIG. 2, preferably of a fluent nature such as cement or steel shot. With a trailer overall length of 480", the frame 18 will weigh approximately 28,000 pounds, and 8000 pounds of cement may be received therein. Steel shot would produce a greater counterweight than cement.

In the practice of the invention, the entire trailer frame 18 forms a torque box and produces a rigidity to twisting and deformation which is not possible with conventional frames upon which aerial apparatus is mounted. Further, the heavy counterweight effect of the frame improves the stability of the aerial apparatus, and a trailer constructed in accord with the concepts of the invention is capable of supporting a 135' extendable ladder with excellent stability in both the lateral and parallel directions with respect to the frame.

It is appreciated that various modifications to the invention concepts may be apparent to those skilled in the art without departing from the spirit and scope of the invention.

We claim:

1. A trailer for supporting aerial apparatus comprising, in combination, an elongated frame having a front end, a rear end, lateral sides, an upper portion and a bottom portion, a tractor hitch defined on said frame front end, wheels rotatably mounted on said frame adjacent said rear end, aerial apparatus support means supported on said frame extending above said upper portion, said lateral sides being defined by channel beams having a base and upper and lower legs extending therefrom, said bottom portion comprising a thick metal bottom flat plate affixed to said lower legs, said bottom plate laterally extending beyond said lateral side channel beams when misaligned with respect to said wheels, said channel beams and bottom plate comprising impervious plates defining a receptacle, an initially fluent counterweight within said receptacle confined by said channel beams and bottom plate, and a plurality of reinforcing plates within said frame obliquely extending between and affixed to said channel beams resisting lateral twisting of said frame.

2. In a trailer for supporting aerial apparatus as in claim 1, said reinforcing plates having a vertical dimension substantially equal to the vertical dimension of said frame, said reinforcing plates having a lower edge welded to said bottom plate.

3. In a trailer for supporting aerial apparatus as in claim 1, said upper portion comprising a thick metal upper plate bridging said channel beams' upper legs and affixed thereto whereby said frame comprises a box in transverse cross section.

4. In a trailer for supporting aerial apparatus as in claim 3, said counterweight comprising cement.

5. In a trailer for supporting aerial apparatus as in claim 3, said counterweight comprising steel particles.

6. In a trailer for supporting aerial apparatus as in claim 3, said bottom and upper plates having a thickness of at least $1\frac{1}{2}$ inches.

* * * * *